US005407498A

United States Patent [19]

Kemp

[11] Patent Number: 5,407,498

[45] Date of Patent: Apr. 18, 1995

[54] MECHANICALLY FLUIDIZED RETORT AND METHOD FOR TREATING PARTICLES THEREIN

[75] Inventor: Willard E. Kemp, Houston, Tex.

[73] Assignee: Kemp Development Corporation, Houston, Tex.

[21] Appl. No.: 144,659

[22] Filed: Nov. 2, 1993

Related U.S. Application Data

[63] Continuation-in-part of Ser. No. 911,062, Jul. 9, 1992, Pat. No. 5,303,904, which is a continuation-in-part of Ser. No. 763,339, Sep. 20, 1991, Pat. No. 5,311,379, which is a continuation-in-part of Ser. No. 467,050, Jan. 18, 1990, abandoned.

[51] Int. Cl.[6] ..... C21D 1/06

[52] U.S. Cl. ..... 148/630; 266/252; 266/257

[58] Field of Search ..... 266/252, 257; 148/630; 432/113, 117

[56] References Cited

U.S. PATENT DOCUMENTS

| | | | |
|---|---|---|---|
| 2,872,176 | 2/1959 | Borgnon | 432/113 |
| 3,053,704 | 9/1962 | Munday | 148/630 |
| 3,197,328 | 7/1965 | Jung et al. | 148/630 |
| 3,369,598 | 2/1968 | List | 432/58 |
| 3,401,923 | 9/1968 | Bearce | 432/58 |
| 3,408,236 | 10/1968 | Van Hartesveldt | 148/630 |
| 3,492,740 | 2/1970 | Geipel et al. | 432/15 |
| 4,154,574 | 5/1979 | Keirle et al. | 432/58 |
| 4,193,758 | 3/1980 | Peterson et al. | 432/27 |
| 4,475,958 | 10/1984 | Mühlratzer et al. | 148/630 |
| 4,478,648 | 10/1984 | Zeilinger et al. | 148/630 |
| 4,487,637 | 10/1984 | Padamsee | 148/630 |
| 4,525,389 | 6/1985 | Stemmler et al. | 427/255.1 |
| 4,547,228 | 10/1985 | Girrell et al. | 148/630 |
| 4,623,400 | 11/1986 | Japka et al. | 148/630 |
| 4,637,837 | 1/1987 | Von Matuschka et al. | 148/630 |
| 4,853,024 | 8/1989 | Seng | 432/197 |

*Primary Examiner*—Scott Kastler

*Attorney, Agent, or Firm*—Bush, Moseley, Riddle & Jackson

[57] ABSTRACT

A method and apparatus for diffusion of elements into or out of small metallic particles, the apparatus consisting of a sealed retort 22 horizontally mounted on an axle 36 with the retort subtended in the interior of a heating device 11. Gas and pressure controls communicating through said axle 36 control the interior atmosphere of the retort 26. Small particles 23 to be modified are placed within the retort 22 and the retort is rotated and heated while maintaining the desired gaseous atmosphere. Rotation causes fluid-like tumbling of the particles resulting in uniform heat transfer, thorough mixing and engenders an exchange of ions between the surface and near surfaces of said particles and the atmosphere of said retort or between the particles and other material placed within said retort.

9 Claims, 3 Drawing Sheets

MECHANICALLY FLUIDIZED RETORT AND METHOD FOR TREATING PARTICLES THEREIN

REFERENCE TO RELATED APPLICATION

This application is a continuation in part of application Ser. No. 911,062 filed Jul. 9, 1992, now U.S. Pat. No. 5,308,904, which is a continuation in part of application Ser. No. 763,399 filed Sep. 20, 1991, now U.S. Pat. No. 5,311,379, which is a continuation in part of application Ser. No. 467,050 filed Jan. 18, 1990, now abandoned.

FIELD OF THE INVENTION

This invention relates to a method and apparatus for controlling heat transfer between a retort and particles therein, and more particularly to such a method and apparatus in which the retort is mechanically moved to fluidize particulate material therein.

BACKGROUND OF THE INVENTION

Metallurgical operations on metals rely on the movement of certain elements within the solid matrix of the metal to be treated. Metallurgical operations rely on chemical reaction between elements which may be physically brought together or may be induced to come together by diffusion. An element is any chemical element or substance listed in the periodic table. Elements move within the solid metal by a process of diffusion. Diffusion is encouraged when an element is attracted to another element with which it is more reactive within the same contiguous metal structure. Diffusion also occurs when metals tend to form a more homogenous solid solution. Diffusion of an element within a metal is aided by increasing the temperature of the metal. Transfer of an element from one metal to another or from a gaseous atmosphere into a metal or out of a metal also takes place when the materials are in intimate contact. The employment of precise low pressures is often desirable to assist in this transfer.

Nitriding and carburizing are examples of metallurgical operations in which elements are diffused into the surface of the metal. Annealing, solution treatment, tempering and normalizing are examples of heat treat operations in which internal diffusion takes place.

It is frequently desired to modify the internal structure of tiny particles of metal by diffusing an element into the surface. This invention relates particularly to diffusion of elements such as nitrogen, boron, oxygen, carbon, selenium and palladium which in small amounts cause major change in the properties of metals into which they are diffused. In the case of manufacture of titanium aluminides for instance, it may be desirable to diffuse small amounts of nitrogen into the surface of micron sized particles of titanium to form strong intermetallic compounds with the titanium. These particles may then be blended with pure titanium metal particles and the resulting mass can be extruded to form a macrohomogenous structure having tiny hard particles mixed amongst the softer more ductile particles to provide a new composite metal which combines the high strength of the hard particles with the ductility of the softer particles.

In the purification of certain reactive metals (as indicated in the periodic table) such as tantalum, it is desired to remove all oxygen. It has been demonstrated that a metal such as tantalum having small amounts of oxygen mixed therein, if placed in contact with a more oxygen reactive metal, such as yttrium, in the presence of high temperature and the absence of any oxygen in the atmosphere, will result in the yttrium absorbing the oxygen from the tantalum, thereby purifying the tantalum to a greater degree than is possible with any conventional refining process.

With some processes the transfer of elements may be assisted by employing a second solid material as a catalyst. For instance, it may be desirable to expose certain particles to a gaseous atmosphere containing a desired active element and in order to aid the release of this active element, a third solid material may be introduced so that when all three are in intimate contact with each other, the active element in the gas or the active element in the third material will act as a catalyst to aid the transfer or chemical reaction between the other two materials.

SUMMARY OF THE INVENTION

An apparatus and method for assisting these reactions is the subject of this invention. A sealed horizontal retort is supplied, subtended on at least one axle. Gas ingress and egress means are provided within the axle so that the atmosphere within the retort can be controlled and monitored by exterior means while the retort is heated and rotated. Fine particles of the metal to be treated are placed in the retort so as the retort is rotated the particles are placed in relatively constant motion. The speed of rotation and the diameter of the retort are chosen to maximize the fluid-like behavior of the particles. Although a vacuum may be maintained within the retort, very high rates of heat transfer exist between the retort walls and the particles, and any other items placed within the retort. Further, there is a constant vigorous mixing of the particles within the retort so that individual particles make intermittent contact with the retort walls and with each other and with any other object placed within the retort.

As an example of use, the device may be used to diffuse nitrogen or oxygen into micron-sized particles of titanium. In this case the particles are loaded into the retort about sixty (60) percent full. The retort is sealed and rotated at high temperature, i.e. 800° C. The retort is heated by elements placed around the exterior of the retort and the heat is transferred uniformly throughout the retort by the tumbling fluidizing action of the particles. A high degree of vacuum may be maintained within the retort and a desired amount of active gas may be introduced into the retort. Alternatively, a mixture of inert and active gas may be introduced into the retort with the mixture and the total pressure being maintained so as to produce a partial pressure of the active gas at the desired level. The active gas will be uniformly exposed to the exterior of each particle and by a process of surface absorption and diffusion, the active gas will enter the surface of the particle. Diffusion to depths of 50 microns are possible. Since particle sizes range generally between around 10 to 250 microns, and are usually less than 100 microns, it is possible to diffuse a new element throughout the particles.

In another application, particles of tantalum contaminated with oxygen are placed within the retort. The retort itself may be lined with yttrium or shaped yttrium metal shapes may be interspersed in the particles. The retort is heated to high temperatures, perhaps 1000 C., and a vacuum is drawn on the retort. Temperatures between around 400 C. and 1500 C. will function satisfactorily under certain conditions. The fluidizing action maintains uniform temperature throughout the retort despite the vacuum. The particles are in constant motion and are intermittently in contact with yttrium metal shapes. Since the yttrium is substantially more reactive with oxygen than is tantalum, oxygen atoms are diffused out of the tantalum and react with the yttrium to form yttrium oxide, leaving more pure tantalum particles than can be achieved with conventional purification practice.

In yet a third application, particles containing an active element such as boron are placed within the retort along with workpieces which are fixtured within the retort so as to be in relatively constant contact with the particles. The retort is rotated while heated to high temperature. A gas is introduced into the retort, which will react chemically or catalytically with the particles to enhance the release of the active element boron. The boron then diffuses into the surface of the workpiece providing the desired metallurgical effect.

DESCRIPTION OF THE INVENTION

Figure 1:
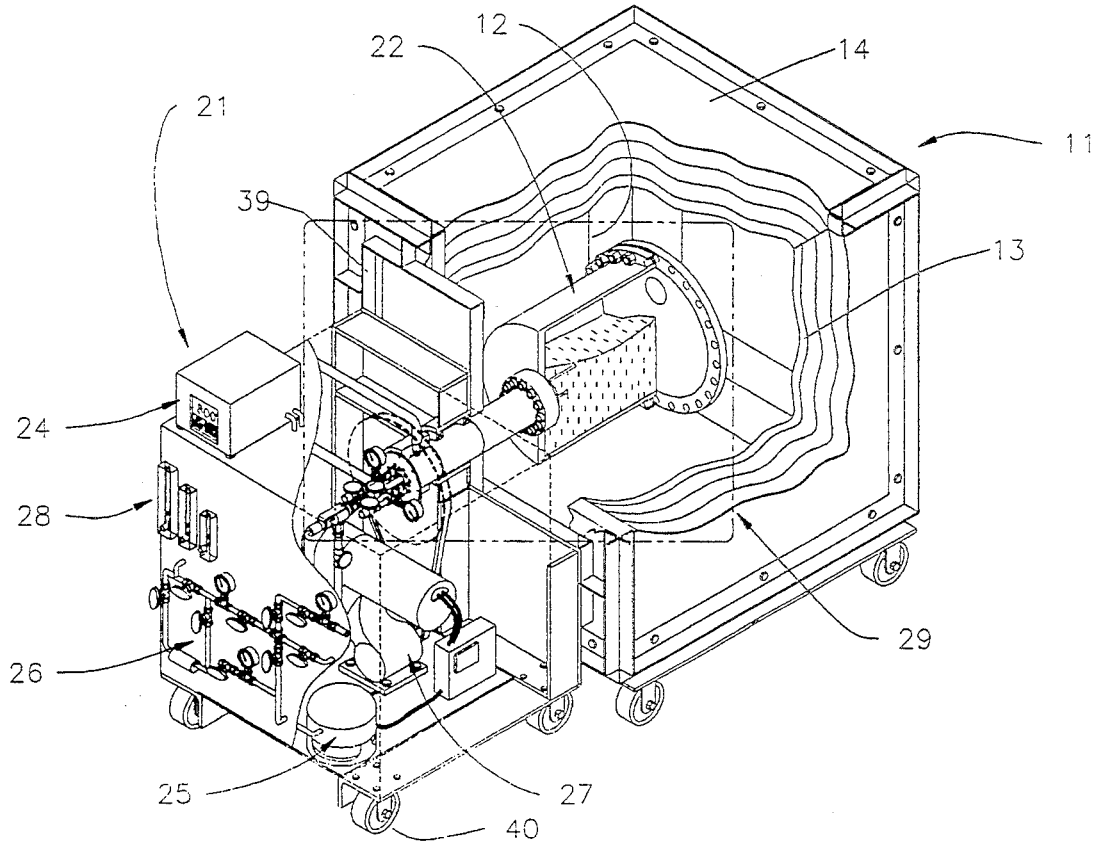
FIG. 1 is a perspective of the treatment apparatus with certain parts broken away and showing a preferred embodiment of the retort.
Figure 2:
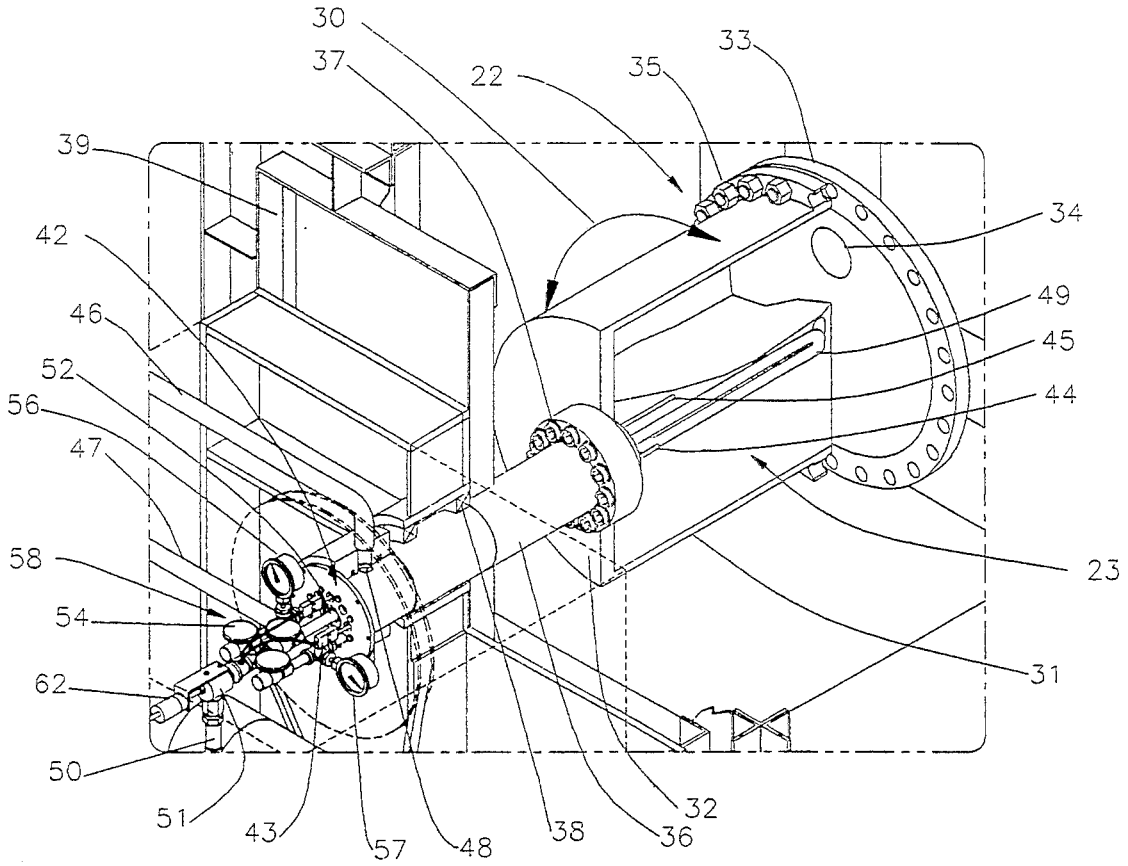
FIG. 2 is a detailed view, indicated as 29 in FIG. 1, of the retort area and its relationship with the mounting axle and control devices.

Referring to the figures the apparatus consists of two principal components. A heater unit is shown generally as 11 and a processing unit is shown as 21. Heater unit 11 has heater coils 12 and insulation 13 supported by frame 14 surrounding the retort 22 containing particles or beads 23. The processing unit is under control of computer 24 and is equipped with a vacuum pump 25, gas control manifold 26, a motor drive 27 and flow control devices 28. Arrows 30 indicates direction of rotation.

Retort 22 consists of cylindrical section 31, integral end cover 32, removable cap 33 having access port 34. The removable cap is retained to cylindrical section 31 by means of bolts and nuts 35. The retort is mounted to the axle 36 by means of bolts 37. The axle is mounted on bearings 38 mounted integrally with insulated closure 39. Insulated closure 39 is mounted to move with the process unit 21. The processing unit is mounted on wheels 40 so that processing unit 21 can be engaged and disengaged with heater unit 11. When processing unit 21 is pulled completely away from heating unit 11, one may then gain access to retort 22. Axle 36 is equipped with numerous passageways indicated generally at 42 which communicate through the axle into the retort. Thermocouple connections 43 pass through access ports 42 and are shown extended into the interior of retort 22 at their sensing ends 44 and 45. Cooling ports 46 and 47 bring cooling fluids into the axle and take spent fluid away from the axle. Said cooling fluid is directed through ports 48 in the axle and thence into U-tube 49 located within the retort so that cooling fluid may be passed through U-tube 49 which is in continuous contact with particles 23 so as to transfer heat quickly and uniformly therebetween.

Gas enters the processing unit through line 50 and through swivel joint 51 and thence through pipe 52 into the interior of the retort. Exhaust gas exits from the retort through pipe manifold 58. Gages 56 and 57 measure the pressure within the retort. Valves 54 may be opened to control gas exiting the retort. Thermocouple wires connecting to thermocouple connections 43 exit through swivel 51 and through commutator 62.

In the typical operation, processing unit 21 and heater unit 11 are separated to provide access to retort 22. Access port 34 is opened and particles are placed into the retort to the extent of about sixty (60) percent full. Access port 34 is then closed with the cover not shown. Bolts and nuts 35 are tightened to assure a good seal between cover 33 and retort 31. Processing unit 21 is then placed in cooperative attachment with heater 11 so that retort 22 is entirely engaged within heater 11. The only connection to the exterior is through axle 36. Drive motor 27 is then activated to rotate the axle and the retort. It has been found advisable to rotate one direction for a period of time and then reverse the direction. For some operations this is not necessary. Gas controls 26 are then operated to create the desired pressure within retort 22. Heater units 12 are activated to heat the exterior of retort 22.

As retort 22 is rotated, particles 23 are constantly intermingled and in contact with each other and the interior of retort 22 and transmit heat from retort wall 31 uniformly throughout the particles. Simultaneously gas mixtures into the retort are thoroughly mixed by the action of the particles so that all particles are thoroughly and uniformly exposed to each other and to the gaseous atmosphere.

In some cases, all atmosphere may be withdrawn from retort 22 through the use of vacuum pump 25. Particles 23 will continue to transmit heat with uniformity within the interior of retort 22. After particles 23 have been exposed to the desired temperature for the desired time, the unit may be quickly cooled by moving cooling fluids through pipe 46 through passageway 48 and U-tube 49 and out pipe 47 so that particles 23 through their continuous contact with U-tube 49 will transmit their heat thereto and into the cooling fluid contained within the cooling tube.

Figure 3:
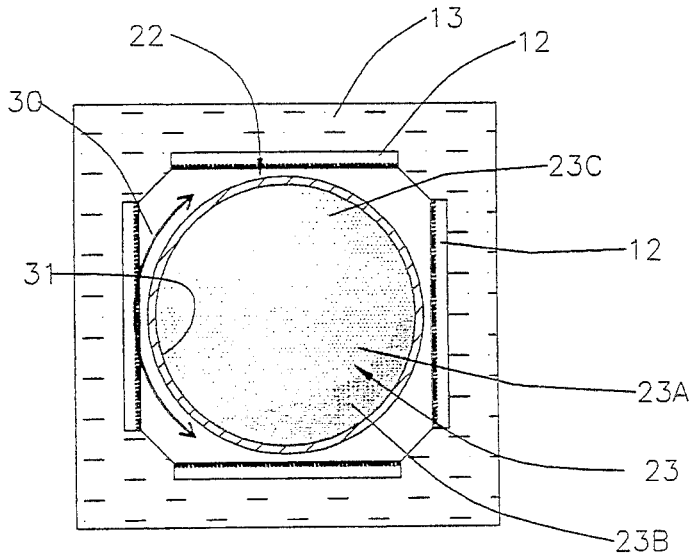
FIG. 3 is a schematic cross section of a retort showing the fluidization action which occurs under proper rotation.

Referring to FIG. 3, the fluidization action of particles 23 results in lowermost particles 23B being unfluidized, upper particles 23C fluidized excessively and the majority of particles 23A fluidized at the desired rate for most efficient heat transfer and mixing. Rotation at speeds of 5 to 40 revolutions per minute result in nearly continuous fluidization of all particles.

Figure 4:
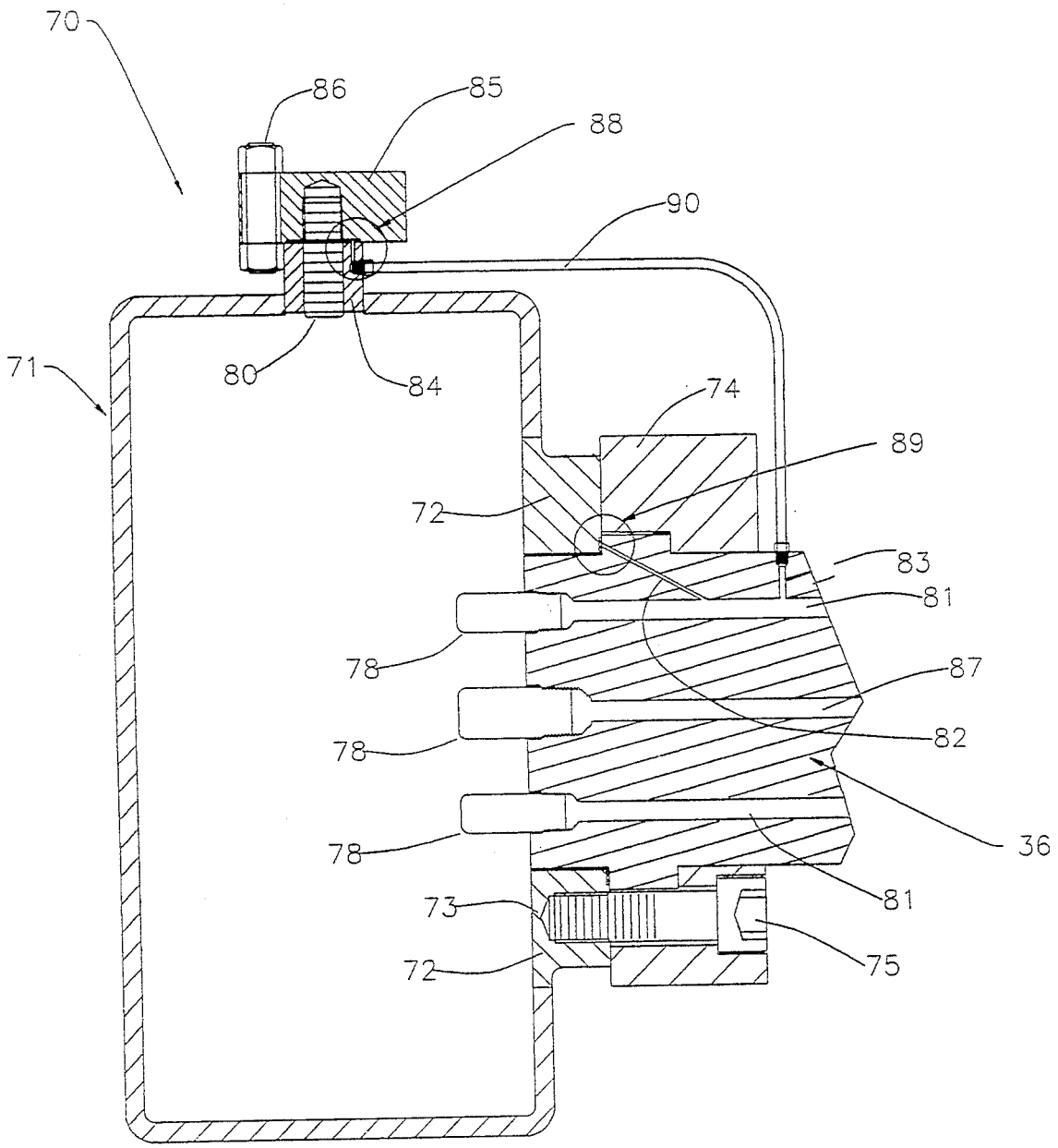
FIG. 4 is a detailed cross section of another embodiment of the retort having a different design and equipped with special sealing features.

Referring now to FIG. 4, a special retort assembly shown generally as 70 is equipped for operations where no possibility of contamination may be tolerated. All exterior leak paths are equipped with dual seals with provision for placing input gas between the two seals so that should any leak occur inwardly it will be of the same gas as is intended for the retort. Retort 71 has enlarged portion 72 with tapped hole 73 for engaging bolts 75 which hold retort assembly 70 to axle 36 by engagement with flange 74. An outlet 84 is welded to the exterior retort 71 covered with a cap 85, retained by bolts and nuts 86. A separate stud 87 is made a part of the cap assembly so as to avoid creation of a cavity within outlet 84. Desired gas input is through ports 81 and exit is through port 87. Filters 78 are mounted to the ends of ports 81 and 87 so that gas may flow from ports into and out of the retort but particles may not pass therebetween.

Figure 5:
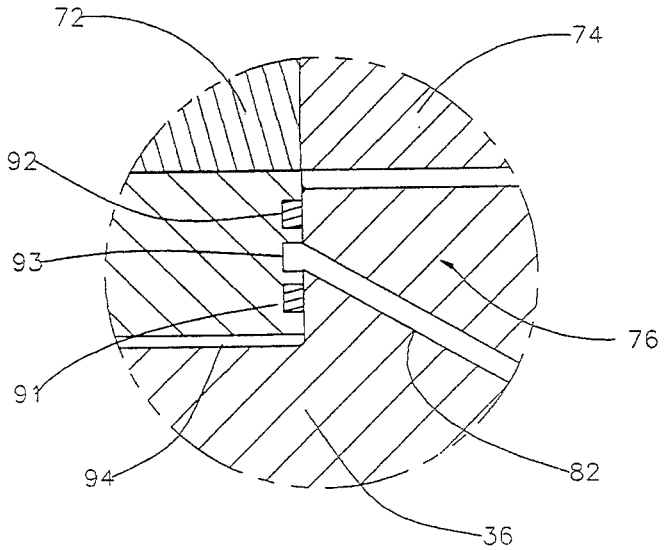
FIG. 5 is a detail of the nozzle seal area on the retort shown as 99 in FIG. 4.

FIG. 5 is an enlargement of the circled area shown as 89 in FIG. 4 and displays the detail of the seal structure between retort 71 and axle 76. An outer seal 92 and an inner seal 91 have between them groove 93 communicating through airway 82 with passageway 81 which contains the desired gas mixture fed into the retort normally through filter 78. If inner seal 91 should fail for any reason, gas will pass from groove 93 past seal 91 into passageway 94 which connects to the interior of retort 71. Thus any leakage will merely be an alternate supply of desired gas.

Figure 6:
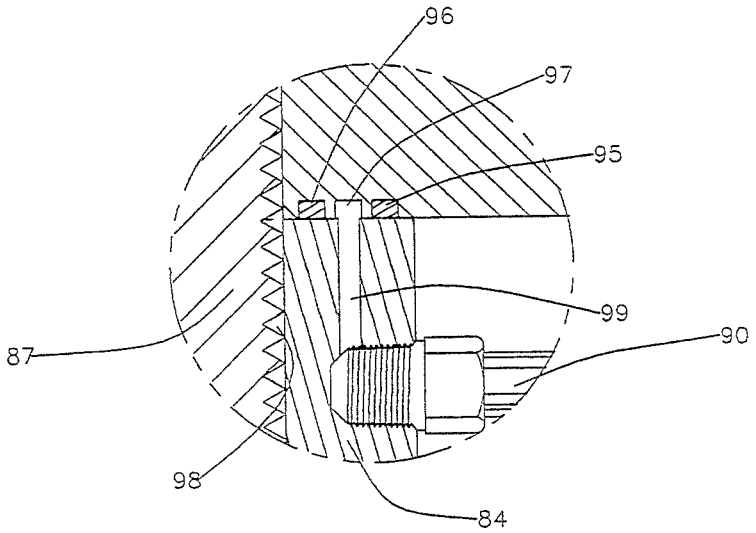
FIG. 6 is a detail of the mounting seal area on the retort shown as 89 in FIG. 4.

FIG. 6 is an enlarged view of the area shown as 88 in FIG. 4. Outlet 84 is closed by access cap 85 having an inner groove 96 and outer groove 95 and gas groove 97 therebetween. Gas from supply line 81 passes through the bypass port 83 thence through tube 90 connected to port 99 feeding gas to groove 97. If the inner seal 96 should for any reason leak, supply gas from groove 97 past seal 96 into the threaded area 98 between stud 87 and outlet 84 into the interior of retort 71. Thus a way has been provided that under no circumstances will failure of a seal allow external atmospheres to enter the retort.

While preferred embodiments of the present invention have been illustrated, it is apparent that modifications or adaptations of the preferred embodiments will occur to those skilled in the art. However, it is to be expressly understood that such modifications and adaptations are within the spirit and scope of the present invention as set forth in the following claims.

What is claimed is:

1. A method of diffusing an active element into the surface of metal workpieces, said method comprising the following steps:

providing a retort mounted about a generally horizontal axis for rotation and having an outer wall;

placing said metal workpieces within said retort;

placing within said retort particles which contain said active element for diffusion into the surface of said metal workpieces, said particles capable of being fluidized and being in contact with said metal workpieces;

supplying a gas at a selected controlled pressure within said retort;

rotating said retort during supply of said gas at a speed sufficient to fluidize said particles; and heating the outer wall of said retort while said retort is rotated for the transfer of energy through said outer wall of said retort and thence into said particles and thence into said metal workpieces effecting diffusion of said active element into the surface of said metallic workpieces.

2. The method as set forth in claim 1 including the step of:

supplying a gaseous element with said gas supplied to said retort, said gaseous element reacting with said first mentioned active element to enhance diffusion of said first mentioned active element into said metal workpieces.

3. The method as set forth in claim 1 including the steps of:

providing a first conduit along said horizontal axis for supply of said gas to said retort; and providing a second conduit along said horizontal axis for the exhaust of gas from said retort.

4. A method of diffusing an active element into the surface of metallic particles, said method comprising the following steps:

providing a retort mounted about a generally horizontal axis for rotation and having an outer wall;

placing said metal particles within said retort for partially filling said retort;

supplying a gas containing said active element at a selected controlled pressure within said retort;

rotating said retort during supply of said gas and active element at a speed sufficient to fluidize said metallic particles; and heating the exterior of said retort while said retort is rotated for the transfer of energy through said outer wall of said retort and thence into said metallic particles effecting diffusion of said active element within said gas into said metallic particles.

5. The method as set forth in claim 4 including the steps of:

providing a first conduit along said horizontal axis for supply of said gas to said retort; and providing a second conduit along said horizontal axis for the exhaust of gas from said retort.

6. The method as set forth in claim 4 including the step of supplying a gas containing an active element selected from the group consisting of nitrogen, oxygen and boron.

7. A method of purifying metallic particles of a size not greater than 100 microns with said metallic particles capable of being fluidized and initially being alloyed with an undesirable active element, said method comprising the following steps:

providing a retort mounted about a generally horizontal axle for rotation and having an outer wall;

placing said metallic particles within said retort;

placing reactive metal elements of a size larger than the largest of said metallic particles within the outer wall of said retort, said reactive metal elements having a greater affinity for said undesirable active element than said metallic particles;

rotating said retort at a speed sufficient to fluidize said metallic particles and to cause said metallic particles to thoroughly intermix and intermittently contact said larger reactive metal elements;

supplying an inert atmosphere or vacuum to the interior of said retort; and heating the outer wall of said retort while said retort is rotated for the transfer of heat energy through the outer wall of said retort and thence into said metallic particles and said large reactive metal elements so that said undesired active element moves by diffusion within said metallic particles to the surface of said metallic particles and then reacts with the surface of said large reactive metal elements.

8. The method as set forth in claim 7 including the step of placing yttrium within the outer wall of said retort for comprising said reactive metal particles.

9. An apparatus for diffusion of a predetermined active element into or out of metallic particles capable of being fluidized; said apparatus comprising:

a substantially horizontally disposed retort having exterior and interior surfaces and adapted to receive the metallic particles therein;

a substantially horizontally disposed axle for said retort mounted for rotation about its axis;

means to rotate said axle at a desired rotational speed for fluidizing of said metallic particles;

means to attach said axle in sealing relationship with said retort;

means for sealing said retort interior surfaces from the outside atmosphere;

means for controlling the pressure of a gas within said retort including a first gas conduit within said axle adapted for rotation with said axle;

a second fixed gas supply conduit in fluid communication with said first gas conduit for supplying said gas thereto at a selected pressure during rotation of said axle and said first gas conduit;

a swivel connection between said first gas conduit and said second gas conduit to permit a controlled supply of said gas at a selected pressure to be continuously supplied to said first gas conduit from said second gas conduit during rotation of said axle and said retort;

means for retaining said metallic particles within said retort while said gas passes between said retort and said first and second conduits; and means to maintain a desired temperature within said retort while maintaining the desired rotational speed for fluidizing said particles.

* * * * *